US008163987B1

(12) United States Patent
Dennis

(10) Patent No.: US 8,163,987 B1
(45) Date of Patent: Apr. 24, 2012

(54) VIBRATO STRING RETAINER BRACKET

(75) Inventor: Terrance Dennis, Ringoes, NJ (US)

(73) Assignee: U.E. Corp., Ringoes, NJ (US)

( * ) Notice: Subject to any disclaimer, the term of this patent is extended or adjusted under 35 U.S.C. 154(b) by 0 days.

(21) Appl. No.: 13/004,067

(22) Filed: Jan. 11, 2011

(51) Int. Cl.
*G10D 3/00* (2006.01)

(52) U.S. Cl. ..... 84/313; 84/297 R; 84/298; 84/299

(58) Field of Classification Search ..... 84/313, 84/297 R, 298, 299
See application file for complete search history.

(56) References Cited

U.S. PATENT DOCUMENTS

| | | | | | |
|---|---|---|---|---|---|
| 487,879 | A | | 12/1892 | Middlebrooke | |
| 2,029,135 | A | | 1/1936 | Stanley | |
| 2,514,835 | A | | 7/1950 | Bredice | |
| D170,109 | S | * | 8/1953 | Bigsby | D17/21 |
| 2,781,685 | A | * | 2/1957 | White et al. | 84/312 R |
| 3,056,329 | A | | 10/1962 | Butts | |
| 3,124,991 | A | * | 3/1964 | Costen | 84/267 |
| 3,162,083 | A | * | 12/1964 | Webster | 84/313 |
| 3,252,368 | A | * | 5/1966 | Jeffery et al. | 84/313 |
| 3,422,509 | A | * | 1/1969 | Porter | 84/313 |
| 3,457,821 | A | * | 7/1969 | Huis et al. | 84/313 |
| 4,128,033 | A | | 12/1978 | Petillo | |
| D348,280 | S | * | 6/1994 | Fessenden | D17/21 |
| 5,661,252 | A | | 8/1997 | Krawczak | |
| 7,045,693 | B2 | | 5/2006 | Rose | |
| 7,709,713 | B1 | * | 5/2010 | Pearce et al. | 84/313 |
| 7,851,684 | B1 | | 12/2010 | Anderson | |
| 8,071,868 | B2 | * | 12/2011 | Dennis | 84/313 |
| 2010/0000392 | A1 | | 1/2010 | Uberbacher | |
| 2010/0011936 | A1 | * | 1/2010 | Dennis | 84/313 |
| 2010/0294110 | A1 | * | 11/2010 | Towner | 84/313 |
| 2011/0154972 | A1 | * | 6/2011 | Bisheimer | 84/298 |

OTHER PUBLICATIONS

Unknown author, Sta-Tuned™ web page, URL: http://www.keepguitarintune.com/Keep-GuitarIn-Tune-Vibrato-Fine-Tuner.php; last viewed Jan. 10, 2011; document web_page_sta-tuned.pdf submitted herewith.

* cited by examiner

*Primary Examiner* — Elvin G Enad
*Assistant Examiner* — Robert W Horn
(74) *Attorney, Agent, or Firm* — Lawrence Lambelet

(57) ABSTRACT

The present invention provides a bracket, which can be easily installed to a vibrato device having a string bar with projecting string pins. The bracket facilitates re-stringing the strings through slots which are conveniently placed and readily accessible to the installer.

10 Claims, 3 Drawing Sheets

VIBRATO STRING RETAINER BRACKET

This is a Non-Provisional Patent Application.

FIELD OF THE INVENTION

This invention relates to vibrato devices for guitars, and more particularly to adjunct equipment relative thereto, and most particularly to apparatuses that facilitate re-stringing relative thereto.

BACKGROUND OF THE INVENTION

The strings of a guitar are anchored near the lowermost end of the guitar body by a tailpiece. Occasionally, this tailpiece function is served by a vibrato, or tremolo, which is a piece of equipment designed to produce a unique sound effect similar to a singer's vibrato.

Vibrato mechanisms provide a means for changing the tension on all the strings of a guitar simultaneously. Changing the tension creates a pitch change in each vibrating string. This is accomplished by a moving tailpiece which pivots about an axis substantially perpendicular to the strings. A handle is provided to facilitate a pulse-like pivoting of the tailpiece while simultaneously playing the instrument.

There are numerous examples of vibrato devices and like mechanisms in the prior art. Three of these, which characterize the genre, are U.S. Pat. No. 4,497,236 to Rose, U.S. Pat. No. 4,632,005 to Steinberger, and U.S. Pat. No. 3,457,821 to McCarty et al. The latter patent is progenitor to what is now known as the Bigsby® family of vibrato devices, arguably the preferred choice for both after-market and factory-installed devices of this type.

Bigsby vibrato devices are installed on top of the guitar in an original equipment installation, or after removing an existing tailpiece in an after-market installation. The installation procedure is to string the strings over a pivoting metal bar, called the string bar, which is a component of the vibrato mechanism. Pins project from the string bar to connect with the strings by threading through a hole in the ball-end of each string. The pins, however, are oriented at a downward and forward angle, such that the wires have to be bent approximately 315° around the string bar. The pins must be in this attitude in order to prevent the strings from slipping off the pins when the bar is pivoted to lighten the string tension and create the desired pitch change. Assembling the strings, however, can be an awkward process. The pin is approached from a blind side and from underneath the bar, below which a minimal clearance for finger manipulation is afforded. As a result, the installer must grope in tight space to pin a tiny hole, and often the process is hit or miss. A simplified means for connecting the strings would shorten the installation time and save frustration on the part of the installer. It would also make it easier for a musician having to change a string.

The range of pitch change is limited both by the radius of rotation of a vibrato device and the degree of articulation about its axis of rotation. Because a Bigsby vibrato mounts to the surface, and does not require the routing of a nesting location in the body of a guitar, its profile is relatively shallow. As a consequence, the range of a Bigsby is essentially limited by the radius of the string bar. This characteristic suits musicians who prefer slow, subtle, or extended blends, but even these musicians would benefit from a broader range, preferred by other musicians, for a choice to increase the sound dynamic.

The present invention improves upon the widely-used Bigsby vibrato design. It to addresses the aforementioned deficiencies, namely finicky installation and limited range, by providing a novel, universal and inexpensive bracket as an adjunct piece of equipment.

SUMMARY OF THE INVENTION

It is accordingly an object of the present invention to provide a simplified means to assemble guitar strings to a Bigsby vibrato device. It is a further object to extend the rotational radius of the string bar of a Bigsby device, and therefore broaden the tonal range, by leveraging the string anchor points. It is a further object to accomplish the above two objectives by providing an easy-to-install and inexpensive bracket. It is a further object to make said bracket universal for all presently-marketed Bigsby vibrato products.

These objectives, and others to be discovered through further disclosure herein, and through practice of the invention, are embodied in a string attachment bracket for a vibrato unit having a string bar with string pins mounted to a guitar with a plurality of strings. The string attachment bracket comprises a shaped plate having distal and proximal ends. The proximal end has a concave form to wrap, at least partially, around the string bar to reach the string pins. The distal end is positioned for enabling quick string connections thereto. The string attachment bracket further comprises one or more apertures through the proximal end adapted for receiving the string pins. Additionally, the bracket comprises a plurality of slots at the distal end, the plurality of slots being to equal or greater than the number of strings. The slots are adapted for slidingly receiving each string in a slot and for capturing a bulbous end of the string therein. When tension is applied to the strings connected at the distal end, with the shaped plate is biased against the string bar by the string pins at the proximal end, the strings are caused to be anchored in the balance of forces.

All Bigsby vibrato units, as elements of design, have the recited string bar and projecting string pins. The distal end of the shaped plate relocates the anchor point of the strings from the string pins to a location free from intervening structures, such as the string bar. The slots in the distal end allow for simplified and quick assembly of the strings to the vibrato device.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings and the following detailed description, in which like reference characters designate the same or similar parts throughout the several views, and wherein.

DETAILED DESCRIPTION OF THE PREFERRED EMBODIMENT

Figure 1:
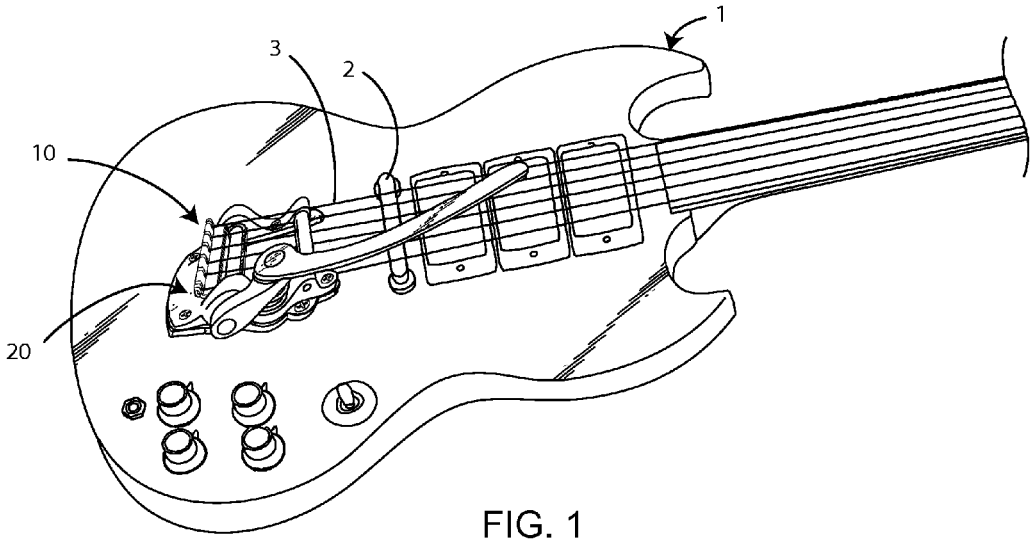
FIG. 1 is a perspective view of the string attachment bracket of the present invention installed with a vibrato device on a guitar.

FIG. 1 shows a string attachment bracket 10 installed on vibrato device 20 with the vibrato device 20 mounted on a guitar 1. A plurality of strings 3 are terminated at the string attachment bracket 10 after passing over a bridge 2. Because the strings 3 are caused to bend over the bridge 2, the bridge effectively determines the vibrating length of the string. The string attachment bracket 10 facilitates the re-stringing of the strings 3, which may follow from routine maintenance on the strings, or which otherwise may be necessitated by an after-market installation of a vibrato device.

Figure 2:
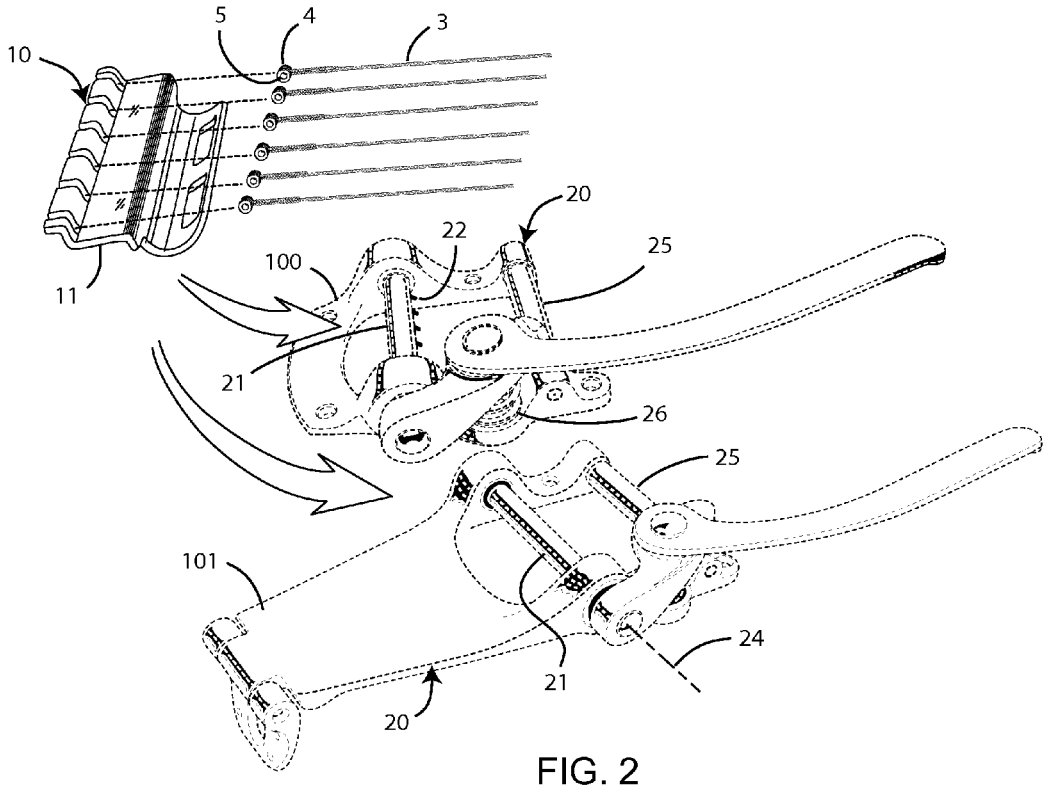
FIG. 2 is a perspective view of several of the constituent parts of a vibrato installation, including a Bigsby B5 vibrato, an alternate Bigsby B7 vibrato, the guitar strings with ball-end finials, and the string attachment bracket.
Figure 3:
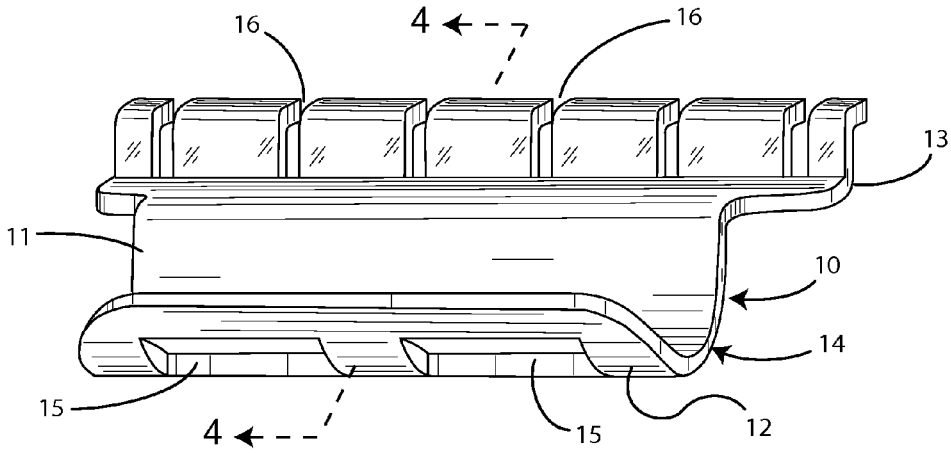
FIG. 3 is a perspective view of the string attachment bracket.
Figure 4:
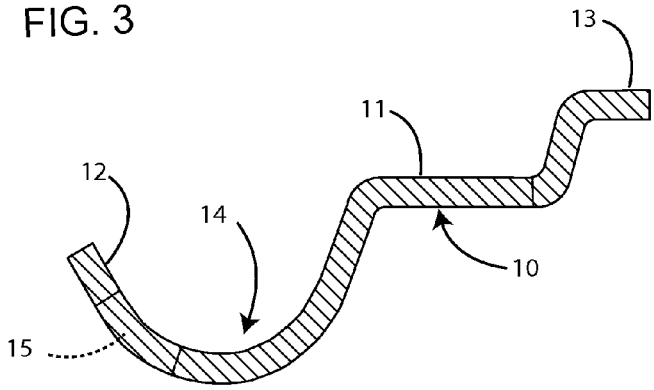
FIG. 4 is a section view of the string attachment bracket taken along the lines 4-4 in FIG. 3.

FIG. 2 shows two of the vibrato devices 20 compatible with string attachment bracket 10: A Bigsby B5 vibrato 100 and a Bigsby B7 vibrato 101. The conventional re-stringing procedure for these devices involves connecting a pin hole 5 in a ball end 4 of the string 3 to a string pin 22. The ball end 4 is essentially bulbous in character. The string pins 22 project at a downward angle of approximately 45° from the string bar 21. The angle is critical to prevent the ball ends 4 from slipping off the string pins 22 when the string bar 21 is rotated in a vibrato manipulation. As a consequence of the string pin angle, the strings 3 must be bent around the string bar 21, circumscribing an angle of approximately 315°, to reach the string pins 22 from underneath the string bar 21. The space underneath is narrow and little room is afforded near the pins for working the strings. Further, the strings can be stiff, particularly near the ball ends where the string thickens, and they do not easily yield to the near 90° secondary bend required to thread the pin. As a consequence, re-stringing the strings in a conventional manner can be a pains-taking process, possibly involving multiple hit-or-miss tries, not to mention a quotient of patience, if not frustration.

Figure 6:
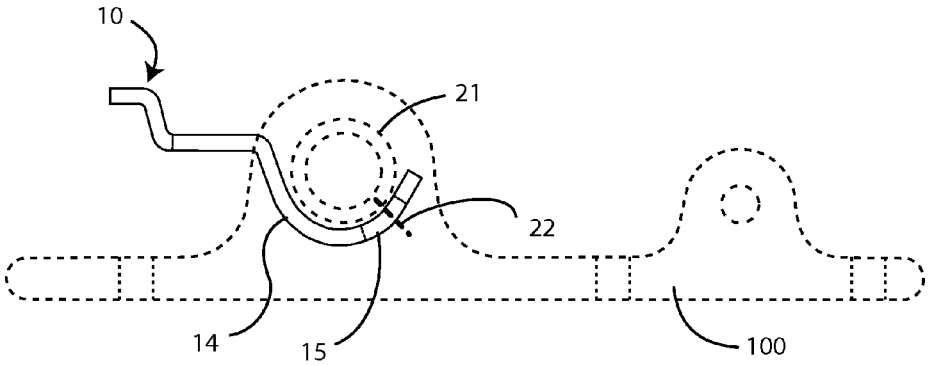
FIG. 6 is a section view taken along the lines 6-6 in FIG. 5B.
Figure 5A:
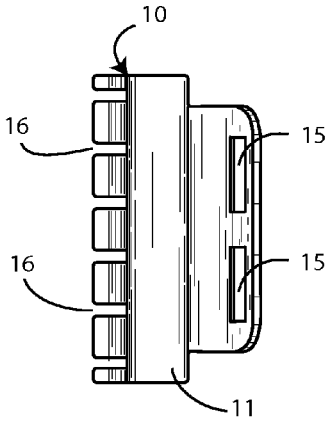
FIG. 5A is a plan view of the string attachment bracket.
Figure 5B:
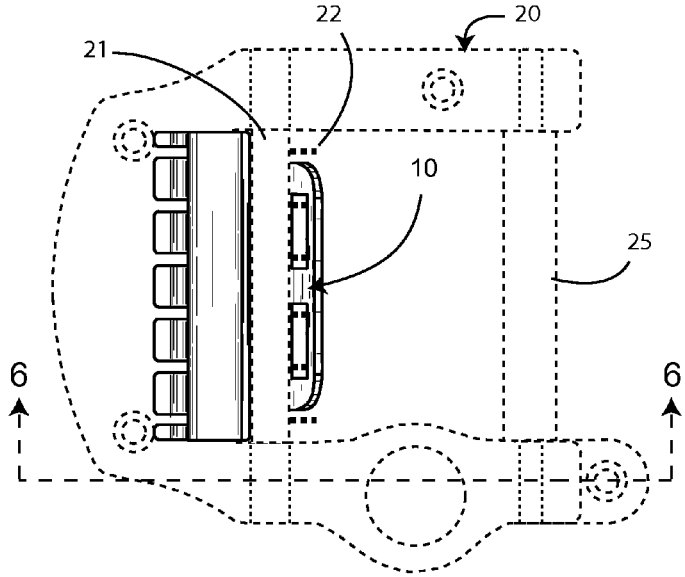
FIG. 5B is a plan view the string attachment bracket positioned on a Bigsby B5 vibrato device.

The novel design of the string attachment bracket 10 remedies this inconvenient process, while also providing other beneficial features. As best shown in FIGS. 2-4 and 5A, the string attachment bracket 10 is comprised of a shaped plate 11 having a proximal end 12 and a distal end 13. The shaped plate 11 can also be described as a "lever arm", reflecting a capacity to leverage a rotational displacement. The string attachment bracket 10 can be easily assembled to the vibrato device 20 by slipping the proximal end 12 underneath the string bar 21. A concave-shaped form 14 of the proximal end 12 positions apertures 15 in location to receive therein the string pins 22. With the string pins 22 positioned in the apertures 15, the distal end 13 of the string attachment bracket 10 is presented in an easily accessible location. FIGS. 5B and 6 show the string attachment bracket 10 mounted to the Bigsby B5 vibrato 100.

Figure 7:
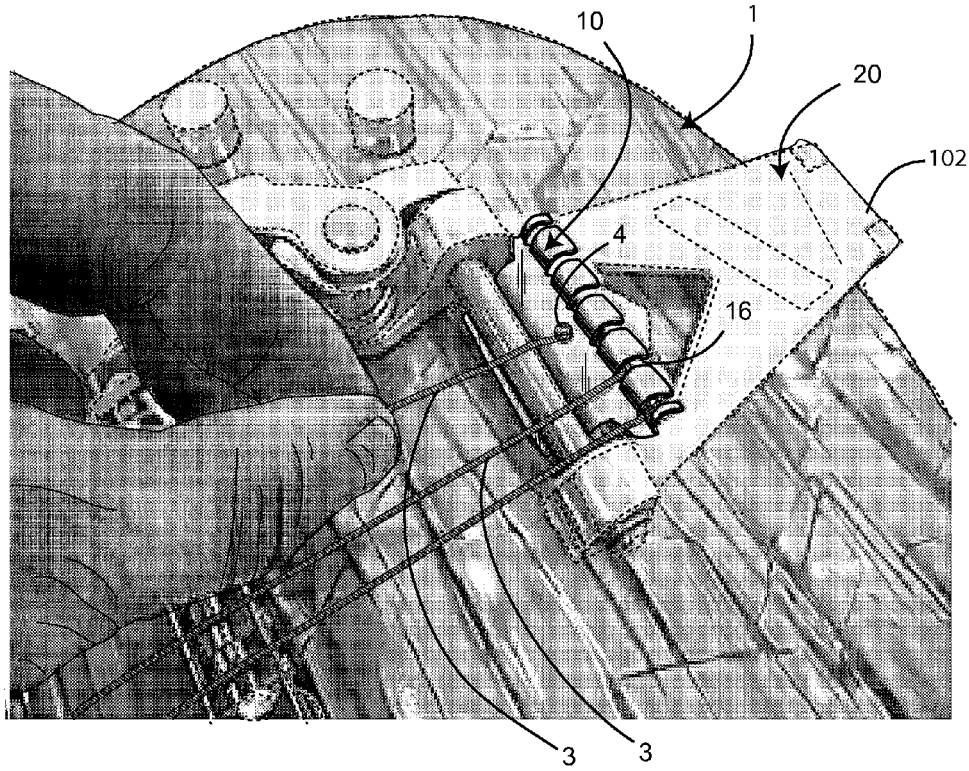
FIG. 7 is a partial perspective view of strings being assembled to a Bigsby B3 vibrato unit mounted on a guitar.

The distal end 13 of the shaped plate 11 conveniently receives the strings 3 in slots 16, wherein they slide to a seated position. At the seated position, the ball ends 4 are held captive by interfering geometries. Ample free space is provided above the distal end 13 for handling and inserting the strings 3, and little bending of the strings, if any, is required to engage the slots 16. The slots 16 may be tapered down from a broad opening to assist with guiding the strings into position. A portion of the shaped plate 11 at the extremis of the distal end 13 may be bent upwardly to avoid bending the strings 3 at a sharp angle when tension is applied thereto. The slots 16 are of a plurality equal to or greater than the number of strings 3, which is, typically, six. FIG. 7 shows the engagement of strings 3 in the slots 16 on the string attachment bracket 10 placed on a Bigsby B3 vibrato 102.

The Bigsby B5 vibrato 100 is fitted with a string hold down bar 25 (FIG. 2). During installation, the strings 3 are threaded beneath the hold down bar 25, the purpose of which is to maintain the bend of the strings over the bridge 2. Not all Bigsby vibrato devices, however, have a hold down bar 25. As a functional requirement, in the case of the absence of a hold down bar 25, the distal end 13 must never raise the strings 3 to an elevation that would essentially eliminate the bend or compromise contact with the bridge 2.

Tensioning the strings on a guitar involves method and means well known in the musical arts. When tension is reapplied to the strings 3 after engagement to the string attachment bracket 10, the force at the distal end 13 is counter-balanced by the string pins 22 at the proximal end 12 acting about a fulcrum at the string bar 21. The string bar 21, and therefore the string pins 22, are biased against rotation in the direction of string tension by a vibrato spring 26 (FIG. 2). The balance of forces keeps the string pins 22, and the strings 3, in continuous contact with the string attachment bracket 10 throughout operational use, including rotation of the string bar 21 during play of the vibrato, providing tension is maintained in the strings.

When the strings 3 are engaged in tension on the string attachment bracket 10 mounted on the vibrato device 20, the string ends are caused to move, when the string bar 21 is pivoted, in an arc defined by the radial distance from the axis of rotation 24 (see FIG. 2). Because the radial distance is greater than in the case of a conventional mounting of the strings 3 about the string bar 21, the greater arc subtended by a common angle will cause a wider fluctuation of tension and, thereby, of pitch. Consequently, the string attachment bracket 10, by repositioning the string ends away from the string pins, produces the beneficial effect of broadening the range of vibrato effect.

The novel string attachment bracket 10 has been configured for compatibility with a multiplicity of Bigsby vibratos, including original series models B3, B5, B6, B7, B11, B12 and B16; licensed series models B30, B50, B60 and B70; and import series models B500 and B700. As a result of the universality comprehended in the design, the longitudinal span of the apertures 15, and any webs inboard or outboard thereto, anticipate all of the pin spacing's in this model group. Furthermore, the widths of the slots 16 accommodate variable thickness of strings and ball end profiles. In the preferred embodiment, the apertures 15 are enlarged to facilitate "fishing" for the string pins 22 from beneath the string bar 21.

In the preferred embodiment, the string attachment bracket 10 is fabricated from metal plate by die-stamping or machining The plate must have sufficient modulus to avoid bending in the force ranges typical for taut musical strings. The preferred metals are stainless steel or aluminum. The preferred thickness for stainless steel is 0.060".

It is to be understood that the invention is not limited in its application to the details of construction and to the arrangements of the components set forth in the preceding description or illustrated in the drawings. For example, the slots may be replaced by pins, or some other feature of connection. Also, it is to be understood that the phraseology and terminology employed herein are for the purpose of the description and should not be regarded as limiting.

What is claimed is:

1. A string attachment bracket for a vibrato device having a string bar with string pins mounted to a guitar with a plurality of strings, comprising:

a shaped plate having distal and proximal ends, the proximal end having a concave form to wrap, at least partially, around the string bar to reach the string pins, the distal end positioned for enabling quick string connections thereto;

one or more apertures through the proximal end adapted for receiving the string pins; and a plurality of slots, the plurality equal to or greater than the number of strings, through the distal end adapted for slidingly receiving each string in a slot and capturing a bulbous end of the string therein;

whereas, with the strings connected in the slots and the string pins in the apertures and with string tension applied at the distal end to bias the proximal end against the string bar acting as a fulcrum, the string attachment bracket anchors the strings for operational purposes.

2. The string attachment bracket of claim 1, wherein the apertures are sized to fit a plurality of string pin counts and layouts, thereby to enable use of the string attachment bracket on a multiplicity of vibrato configurations.

3. The string attachment bracket of claim 1, wherein the openings of the slots are sized to accommodate a plurality of string thicknesses, thereby to enable use of the string attachment bracket on a multiplicity of guitar configurations.

4. The string attachment bracket of claim 1, wherein the openings of the slots are sufficiently ample to facilitate fishing for the string pins, thereby to locate them, from underneath the string bar.

5. The string attachment bracket of claim 1, wherein the positioning of the distal end increases the radius of rotation of the string anchor points to thereby amplify the variance in tonal pitch.

6. A string attachment bracket for a vibrato unit having a string bar with string pins mounted to a guitar with a plurality of strings, comprising:

a lever arm connected at one end to the string pins and at an opposing end to the strings, the lever arm effectively transitioning the anchor point of the strings away from an inconvenient under carriage position;

a means for connecting the lever arm to the string pins to thereby enable the string pins, in their projection from the string bar, to manipulate the lever arm through rotational movement of the string bar; and a means for conveniently attaching the strings to the opposing end of the lever arm;

whereas, with tension applied to the strings, and with the lever arm braced against the string bar, the strings are anchored for operational purposes.

7. The string attachment bracket of claim 6, wherein the means for connecting the lever arm to the string pins comprises one or more apertures at the one end of the lever arm, the lever arm bending around the string bar to position the apertures in location to receive the string pins.

8. The string attachment bracket of claim 6, wherein the means for conveniently attaching the strings comprises a plurality of slots, the plurality equal to or greater than the number of strings, the slots configured to slidingly receive each string in a slot and capture a bulbous end of the string therein.

9. The string attachment bracket of claim 7, wherein the apertures are sized to fit a plurality of string pin counts and layouts, thereby to enable use of the string attachment bracket on a multiplicity of vibrato configurations.

10. The string attachment bracket of claim 8, wherein the openings of the slots are sized to accommodate a plurality of string thicknesses, thereby to enable use of the string attachment bracket on a multiplicity of guitar configurations.

* * * * *